US009635882B2

(12) United States Patent
Eitzinger et al.

(10) Patent No.: US 9,635,882 B2
(45) Date of Patent: May 2, 2017

(54) CIGARETTE PAPER WITH IMPROVED AIR-PERMEABILITY

(71) Applicant: DELFORTGROUP AG, Traun (AT)

(72) Inventors: Bernhard Eitzinger, Gmunden (AT); Maria Gleinser, Wattens (AT)

(73) Assignee: delfortgroup AG, Traun (AT)

( * ) Notice: Subject to any disclaimer, the term of this patent is extended or adjusted under 35 U.S.C. 154(b) by 226 days.

(21) Appl. No.: 14/413,050

(22) PCT Filed: Apr. 29, 2013

(86) PCT No.: PCT/EP2013/001276
§ 371 (c)(1),
(2) Date: Jan. 6, 2015

(87) PCT Pub. No.: WO2014/008962
PCT Pub. Date: Jan. 16, 2014

(65) Prior Publication Data

US 2015/0164132 A1 Jun. 18, 2015

(30) Foreign Application Priority Data

Jul. 9, 2012 (DE) ..... 10 2012 106 154

(51) Int. Cl.
*A24D 1/02* (2006.01)
*D21H 17/26* (2006.01)
(Continued)

(52) U.S. Cl.
CPC ..... *A24D 1/027* (2013.01); *A24D 1/025* (2013.01); *D21H 17/26* (2013.01); *D21H 17/29* (2013.01);
(Continued)

(58) Field of Classification Search
USPC .... 162/139, 158, 173, 175, 177, 178, 181.1, 162/181.2, 181.4, 181.5, 183, 184;
(Continued)

(56) References Cited

U.S. PATENT DOCUMENTS 5,109,876 A * 5/1992 Hayden ..... A24D 1/02 131/365
5,143,099 A 9/1992 Le Gars et al.
(Continued)

FOREIGN PATENT DOCUMENTS

WO WO 01/08514 A1 2/2001
WO WO 2012/076649 A1 6/2012

OTHER PUBLICATIONS

Potassium citrate, Sigma-Aldrich, 2016, [online], retrieved from the Internet, [retrieved Oct. 12, 2016, <URL:http://www.sigmaaldrich.com/catalog/search?term=potassium+citrate&interface=All&N=0&lang=en&region=US&focus=product>.*
(Continued)

*Primary Examiner* — Dennis Cordray
(74) *Attorney, Agent, or Firm* — Sunstein Kann Murphy & Timbers LLP

(57) ABSTRACT

A cigarette paper is shown which has the following properties over at least a part of its surface: no artificial perforation, the air permeability is at least 15 CU, preferably at least 20 CU, and especially preferably at least 25 CU, and for the exponent k, measured with a measuring head with a rectangular opening of 2 mm by 15 mm, in accordance with ISO 2965:2009, which is defined by $$k = \frac{\log\frac{Q_1}{Q_2}}{\log\frac{p_1}{p_2}}$$

(Continued)

with $Q_1$: air-flow through the paper at a pressure difference $p_1$=1.00 kPa and $Q_2$: air-flow through the paper at a pressure difference $p_2$=0.25 kPa, the following holds k≤0.98, preferably k≤0.95, especially preferably k≤0.93, and k≥0.80, preferably k≥0.85.

3 Claims, 1 Drawing Sheet

(51) Int. Cl.
*D21H 17/29* (2006.01)
*D21H 27/02* (2006.01)
*D21H 27/08* (2006.01)
*D21H 27/00* (2006.01)

(52) U.S. Cl.
CPC ..... *D21H 27/00* (2013.01); *D21H 27/02* (2013.01); *D21H 27/08* (2013.01)

(58) Field of Classification Search
USPC ..... 131/360, 365
See application file for complete search history.

(56) References Cited

U.S. PATENT DOCUMENTS

| | | | | |
|---|---|---|---|---|
| 6,779,530 | B2 * | 8/2004 | Kraker | A24C 5/005 131/349 |
| 8,646,464 | B2 * | 2/2014 | Hampl, Jr. | D21F 11/00 131/284 |
| 8,807,144 | B2 * | 8/2014 | Hampl, Jr. | A24D 1/025 131/334 |
| 8,869,805 | B2 * | 10/2014 | Wanna | A24D 1/025 131/365 |
| 2007/0102017 | A1 | 5/2007 | Sherwood et al. | 131/365 |
| 2007/0246055 | A1 | 10/2007 | Oglesby | 131/365 |
| 2009/0223529 | A1 * | 9/2009 | Hampl, Jr. | D21F 11/00 131/365 |

OTHER PUBLICATIONS

International Searching Authority—EPO, English Translation of—International Search Report and Written Opinion, PCT/EP2013/001276; dated Jul. 16, 2013. 6 pages.
International Searching Authority—EPO, International Search Report and Written Opinion, PCT/EP2013/001276; dated Jul. 16, 2013. 9 pages.

* cited by examiner

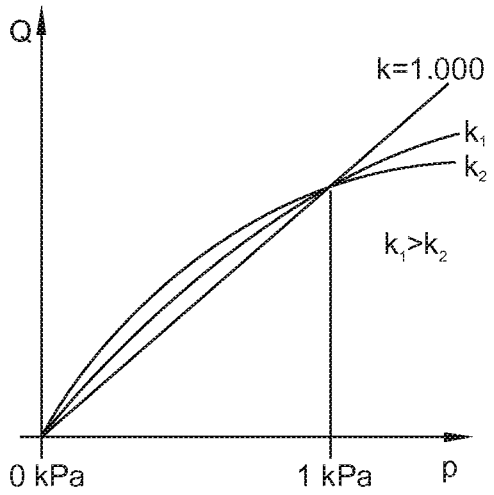
Q
k=1.000
$k_1$
$k_2$
$k_1>k_2$
0 kPa
1 kPa
p

CIGARETTE PAPER WITH IMPROVED AIR-PERMEABILITY

FIELD OF THE INVENTION

The present invention relates to a cigarette paper. Particularly, it relates to a cigarette, which obtains higher dilution of the smoke, compared to a conventional cigarette paper of approximately equal air permeability, but which otherwise deviates chemically and physically as little as possible from a conventional cigarette paper.

BACKGROUND OF THE INVENTION

It is well known that cigarette smoke contains many harmful substances. Consequently, there exists an interest in the industry to produce cigarettes the smoke from which contains considerably fewer harmful substances. There are various approaches to reducing the amount of such substances. For example, cigarettes are often equipped with filters, typically made of cellulose acetate, which can absorb a part of the particulate phase of the smoke, generally called "tar". Other methods aim to dilute the smoke generated in the cigarette, for example with an air flow flowing through a perforation in the tipping paper. In addition, by its defined air permeability, the cigarette paper wrapping the tobacco rod allows air to flow into the tobacco rod of the cigarette, which dilutes the smoke. Finally, the amount of harmful substances in the smoke of a cigarette can be influenced by selection of the tobacco blend.

Typical cigarette papers comprise cellulose fibers, among others, which are produced from wood, flax or other materials. In addition, mixtures of cellulose fibers of different origins are used.

A characteristic property of the cigarette paper of great technical importance is its air permeability. It describes the permeability of the paper to an air-flow, which is caused by a pressure difference between the two sides of the paper. More precisely, it describes the volume of air flowing through the paper per unit time, per unit area and per pressure difference and thus has the dimension $cm^3/(min\ cm^2\ kPa)$, which is frequently called the CORESTA Unit (CU), wherein 1 CU=1 $cm^3/(min\ cm^2\ kPa)$. Known cigarette papers exhibit an air permeability between 10 CU and 300 CU, wherein the range of 20 CU to 120 CU is most commonly used.

The air permeability can, for example, be determined in accordance with ISO 2965. According to ISO 2965, the volume of air flowing through a rectangular opening with a width of 10 mm and a length of 20 mm per unit time at a pressure difference of 1 kPa is determined and expressed in CU units. Alternatively, in accordance with ISO 2965, a rectangular opening with a width of 2 mm and a length of 15 mm can be used.

An assumption which very closely approximates to conventional cigarette papers is that the air-flow through the cigarette paper is proportional to the pressure difference in the range of pressure differences to which the cigarette paper on a cigarette during smoking is exposed. Hence a linear relationship exists between pressure difference and air-flow through the paper. The typical pressure difference between the inside and the outside of the cigarette during smoking is between 0 kPa and 1.0 kPa.

In Annex D.2 (ISO 2965:2009), ISO 2965 allows the non-linearity of the relationship between air-flow and pressure difference to be estimated. For this purpose, at least one measurement of the air-flow $Q_1$ at a pressure difference $p_1$=1.0 kPa and one measurement of the air-flow $Q_2$ at a pressure difference of $p_2$=0.25 kPa is made. The exponent k is calculated from both measured values in accordance with equation (D.6) in ISO 2965:2009 by $$k = \frac{\log\frac{Q_1}{Q_2}}{\log\frac{p_1}{p_2}}$$

This exponent k describes the non-linearity and is in the range of 0.5 to 1.0, whereby a value of 1.0 describes linear relationships. In this regard, conventional cigarette paper, as stated before, exhibits linear behavior and thus has a value for the exponent k of between 0.98 and 1.0.

Measurement devices that measure the air permeability in accordance with ISO 2965 are commercially available and in most cases also allow the exponent k to be determined. Consequently, here, whenever reference to a value of the exponent k is made, it should be understood that the value is calculated from a measurement at 1.0 kPa and a measurement at 0.25 kPa in accordance with ISO 2965, Annex D.2, with a measuring head with a rectangular opening of 2 mm by 15 mm.

Further technical requirements for the cigarette paper are related to the processability of the cigarette paper on the cigarette machine, for example basis weight, thickness, elongation at break and tensile strength. Additionally, there are further requirements related to the optical properties of the cigarette paper, for example, opacity and whiteness. Furthermore, there are extensive legal regulations for the ingredients allowed in cigarette paper.

But above all, for cigarette paper the influence on the taste of the cigarette plays a major role, as the cigarette is burnt together with the tobacco and the combustion products from the cigarette paper form part of the smoke. Hence, it is important that all modifications to the cigarette paper leave the cigarette paper chemically in an as natural state as possible, so that the components of the cigarette paper do not have a negative influence on the taste of the smoke.

At the same time, there is an interest in controlling the smoke yields of a cigarette by modification of the cigarette paper.

SUMMARY OF THE INVENTION

The invention is based on the objective of providing a cigarette paper that achieves higher dilution of the smoke compared to a conventional cigarette paper of approximately equal air permeability. The cigarette paper should in this regard deviate chemically and physically as little as possible from a conventional cigarette paper in order not to influence the taste and the smoke chemistry.

This objective is achieved by a cigarette paper according to claim 1. The invention further applies to a cigarette manufactured from a cigarette paper according to the invention and a method of manufacturing a cigarette paper according to the invention.

Such a cigarette paper, according to the invention, is characterized in that it has an exponent k for the air permeability of ≤0.98, preferably ≤0.95 and especially preferably ≤0.93. For the lower limit of the exponent k in the context of this invention, k ≥0.80, preferably, k ≥0.85. An exponent k of less than 1.0 means that the relationship between the pressure difference and the air-flow passing through the paper is non-linear. This implies that for two papers of equal air permeability—measured at 1 kPa in accordance with ISO 2965—but with different exponents, the paper with the smaller exponent allows a greater air-flow through the paper if the pressure difference is between 0 kPa and 1 kPa, but a smaller air-flow at pressure differences above 1 kPa. This relationship is illustrated in FIG. 1.

As the pressure difference during smoking of a typical cigarette in the area of the cigarette paper is between 0 kPa and 1 kPa, a paper with the same air permeability but with a smaller exponent allows a greater flow of air into the cigarette and hence a greater dilution of the smoke and consequently a greater reduction in the harmful substances taken up by the smoker.

It should be noted that a non-linear relationship between the pressure difference and the air-flow, that is, a value for the exponent of significantly less than 1, also results for artificially perforated cigarette papers. The term "artificial perforation" should be understood to mean a perforation that is made in the finished cigarette paper and has to be distinguished from the "natural porosity" that results from the fibrous structure of a cigarette paper. The holes, which can, for example, be produced by electrostatic perforation, have a diameter between 30 μm and 100 μm. Using laser perforation, holes with a diameter between 100 μm and 500 μm can be produced. In contrast, a naturally porous cigarette paper has hardly any pores with a diameter ≥10 μm. The present invention specifically does not relate to cigarette papers that feature an artificial perforation. An artificial perforation means an additional effort and can occasionally change the physical properties of the cigarette so much that the cigarette cannot be lit in a conventional manner.

In the case of the invention, the exponent k of the cigarette paper in accordance with the invention may also be sufficiently reduced over only a part of its surface rather than its entire surface. The said part should, however, be at least 30%, preferably at least 50% and especially preferably at least 70% of the total area.

In the context of the invention, a low value of the exponent k can be obtained by increasing the ratio of the number of large pores compared to that of smaller pores in comparison to conventional cigarette papers, but without resorting to artificial perforation.

In an advantageous embodiment, this is accomplished by coating or treating the cigarette paper on said part of its area with a material, especially a film-forming material, the amount of which, however, is comparatively small and does not exceed 2.0 $g/m^2$, preferably 1.5 $g/m^2$. In this manner, the small pores can primarily be sealed. This reduces the air permeability, though only to a comparatively small extent, as the small pores contribute relatively much less to the air permeability than the small pores because of Hagen-Poiseuille's law. A certain decrease in the air permeability is inevitable due to sealing of the small pores, but this can in any case be compensated for by reduced refining of the pulp, which additionally is linked to corresponding energy savings.

It should be noted that coating cigarette papers with film-forming compositions in discrete areas is used in the prior art to provide a cigarette manufactured therefrom with self-extinguishing properties. However, for this, the amounts of material applied are substantially greater than in this embodiment of the invention. In the prior art, areas treated with film-forming compositions, which should provide self-extinguishing properties to a cigarette, typically have an air permeability of 0 to 10 CU. In contrast, the inventive cigarette paper, independently of the way in which the reduced exponent k in accordance with ISO 2965:2009 is obtained, has an air permeability in the corresponding part of its surface which is always at least 15 CU, preferably at least 20 CU and especially preferably at least 25 CU, because self-extinguishing is not the objective of the inventive cigarette paper. This, however, does not exclude the cigarette paper being additionally treated locally to further reduce the air permeability and to provide self-extinguishing properties to a cigarette manufactured from this paper.

For the treatment or coating of the paper, materials are used that preferably are contained in conventional cigarette papers, for example starch, starch derivatives, especially oxidized starch, cellulose derivatives, especially carboxy methyl cellulose, guar, pectin or polyvinyl alcohol. In addition, mixtures of two or more of these materials can be used.

In contrast, materials that substantially change the composition of the smoke are not wanted; rather, a dilution effect is the objective of the invention, which affects all substances in the smoke to approximately the same extent. Furthermore, materials for reduction of the exponent k that have a negative influence on the taste of the cigarette and therefore acceptance of a cigarette manufactured from this paper should be avoided. Preferably, the use of alginates for the treatment of the paper should be avoided.

A film-forming material can be applied in the form of a film-forming composition that comprises at least a liquid and a film-forming material. In the present specification, a material should be understood to be "film-forming" in the proper sense if its components are capable of forming an approximately closed film by mutual cross-linking. For the liquid, water is preferably chosen, but the use of organic solvents can also be considered. For the film-forming material, materials can be considered that form solutions or colloidal suspensions in this liquid, which is the case for the materials mentioned above.

Apart from "film-forming compositions" in their strictest sense, small amounts of a composition can be applied, however, which comprise a liquid and particles of sufficiently small size with which the small pores can be sealed efficiently, to thereby decrease the exponent k with a relatively small change in air permeability. As mentioned before, this small change in air permeability can be compensated for by reduced refining of the pulp. The advantage of adding at least a small amount of a film-forming material is that in this manner, the particles can be fixed better in the cigarette paper.

In a preferred embodiment, the exponent k is varied in said part of the surface, such that it varies along the length of cigarette which can be produced therefrom. Particularly, said part of the surface can have a first and a second part, of which the first part is located closer to the mouth end of the cigarette, on a cigarette which can be produced therefrom, than the second part, whereby the exponent k in the first part is lower than in the second part. An advantage of a lower exponent k in the area of the mouth end or the filter of the cigarette is that in this area, the pressure difference is typically about 0.5 kPa and the effect of the low exponent k is strongest.

In an advantageous embodiment, marks are provided on the cigarette paper, which are in register with said part of the surface. In this way, it can be ensured that during the production of cigarettes manufactured from papers with an exponent k that varies over the length, the treated area on the cigarette is always in approximately the desired position.

If the reduction of the exponent k is obtained, for example, by printing a film-forming composition, such register marks can be applied to the cigarette paper during the printing process. The aforementioned marks can be detected by corresponding control devices on the cigarette machine and cutting of the tobacco rod can be synchronized so that the treated area on the cigarette is always located in the same position.

Preferably, the basis weight of the cigarette paper is between 10 g/m$^2$ and 60 g/m$^2$, especially preferably between 20 g/m$^2$ and 35 g/m$^2$.

Preferably, the cigarette paper contains an inorganic mineral filler that is added to the paper in a fraction of 10% to 45% by weight. Preferably, the fraction is 20% to 45% by weight and especially preferably from 30% to 45%, as when the filler content is high, small pores are primarily formed and exponents k closer to 1 may be expected, so that the invention can be instigated more effectively. Preferred filler materials in this regard are calcium carbonate, magnesium oxide or aluminum hydroxide or combinations thereof.

Preferably, the cigarette paper can be equipped with burn additives that increase or reduce the smoldering speed of the paper. Preferably, the cigarette paper contains at least one burn additive, which can be one or more of the following salts: a citrate, especially a tri-sodium and/or tri-potassium citrate, a malate, a tartrate, an acetate, a nitrate, a succinate, a fumarate, a gluconate, a glycolate, a lactate, an oxylate, a salicylate, a α-hydroxy caprylate and/or a phosphate. To this end, the paper is, for example, impregnated with a solution or suspension of these burn additives in the size press, or the solution or suspension is applied to the surface of the paper in a film press.

The present invention further relates to a method for producing a cigarette paper according to one of the embodiments described above. In this respect, the cigarette paper may, for example, already have been selected such that a correspondingly low exponent k results by appropriate choice of the composition of the paper in combination with the manufacturing process. For example, by selecting the filler material or by selecting the particle size distribution of the filler material, it is advantageously possible to facilitate the formation of larger pores at as early as the paper production stage.

Alternatively, in the context of this invention, it is possible to initially produce a base paper, which still has an exponent k close to 1, and then treat at least a part of the surface of the base paper such that the exponent k is reduced to a value of $k \leq 0.98$, preferably $k \leq 0.95$ and especially preferably $k \leq 0.93$. This method, however, should be carried out such that the value of k does not decrease below a value of 0.80 and preferably not below 0.85, and that the air permeability is maintained at a value of at least 15 CU, preferably at least 20 CU and especially preferably at least 25 CU.

As mentioned above, this method can be carried out by applying an appropriate material, especially a film-forming material. To this end, the material can be applied, preferably in the form of a solution or a colloidal suspension, especially in a printing method such as gravure printing or flexographic printing, by spraying or by application in the size press or film press of a paper machine.

Alternatively, the cigarette paper can be embossed in said part of the surface, or compressed—for example between steel cylinders. During compression, small pores are also preferably sealed, whereupon the value of the exponent k decreases.

BRIEF DESCRIPTION OF THE FIGURES

FIG. 1 shows a schematic drawing of the profile of the air-flow through a cigarette paper as a function of the pressure difference for a cigarette paper with linear behavior (k=1) and two cigarette papers with non-linear behavior ($k_2<k_1<1$).

DESCRIPTION OF THE PREFERRED EMBODIMENTS

The following examples of embodiments serve to illustrate the invention.

COMPARATIVE EXAMPLE 1

A conventional, non-inventive cigarette paper with a basis weight of 25.0 g/m$^2$, manufactured from wood pulp and with a filler material content of 30.2% by weight chalk and impregnated with 1% by weight tri-potassium citrate has a specified air permeability of 125 CU. The exponent k, as a mean value of 10 measurements carried out in accordance with ISO 2965:2009 with a Borgwaldt A10 instrument and a measuring head with a rectangular opening of 2 mm by 15 mm, is 0.9981 with a standard deviation of the single value of 0.0038.

COMPARATIVE EXAMPLE 2

A conventional, non-inventive cigarette paper with a basis weight of 28.0 g/m$^2$, manufactured from wood pulp and with a filler material content of 3.7% by weight chalk and impregnated with 1% by weight tri-potassium citrate has a specified air permeability of 75 CU. The exponent k, as a mean value of 10 measurements carried out in accordance with ISO 2965:2009 with a Borgwaldt A10 instrument and a measuring head with a rectangular opening of 2 mm by 15 mm, is 0.9968 with a standard deviation of the single value of 0.0066.

COMPARATIVE EXAMPLE 3

A conventional, non-inventive cigarette paper with a basis weight of 25.5 g/m$^2$, manufactured from flax pulp and with a filler material content of 24.8% by weight chalk and impregnated with 1.15% by weight tri-potassium citrate has a specified air permeability of 55 CU. The exponent k, as a mean value of 10 measurements carried out in accordance with ISO 2965:2009 with a Borgwaldt A10 instrument and a measuring head with a rectangular opening of 2 mm by 15 mm, is 0.9972 with a standard deviation of the single value of 0.0061.

COMPARATIVE EXAMPLE 4

A conventional, non-inventive cigarette paper with a basis weight of 25.5 g/m$^2$, manufactured from wood pulp and with a filler material content of 27.5% by weight chalk and impregnated with 0.85% by weight of a 1:1 by weight mixture of tri-sodium and tri-potassium citrate has a specified air permeability of 19 CU. The exponent k, as a mean value of 10 measurements carried out in accordance with ISO 2965:2009 with a Borgwaldt A10 instrument and a measuring head with a rectangular opening of 2 mm by 15 mm, is 0.9989 with a standard deviation of the single value of 0.0037.

Comparative Examples 1-4 show that conventional cigarette papers generally have an exponent k between 0.99 and 1.00 over the entire range of the technically preferred air permeability and independently of the choice of the pulp or the filler material content. In contrast to that are the inventive papers, which all have exponents k below this range.

In each of the following exemplary embodiments 1-6 a film-forming composition was applied to the cigarette paper with a laboratory printer from Erichsen, the K Printing Proofer model, serial number 87772. To achieve the inventive effect, the speed setting was set to the maximum, level 10, and also the doctor blade was set to the maximum contact pressure. In addition, a very high or the maximum possible (exemplary embodiment 4) contact pressure was selected for the impression roller. Experiments have shown that to carry out the invention, these extreme settings of the laboratory printer are important, inter alia. The printing plate had a screen ruling of 100 lines per inch.

Exemplary Embodiment 1

The entire surface of the cigarette paper of Comparative Example 2 was coated with a film-forming composition, specifically with an aqueous solution of 0.5% by weight of a carboxy methyl cellulose, Blanose® CMC 7MCF, using the laboratory printer. The paper was dried after coating and the applied amount was determined to be 1.04 g/m$^2$ by measurement of the basis weight in accordance with ISO 536 before and after coating. The air permeability and the exponent k were measured 10 times in accordance with ISO 2965:2009 with a Borgwaldt A10 instrument and a measuring head with a rectangular opening of 2 mm by 15 mm, and the mean value was calculated. The mean value for the air permeability was 70.0 CU, the mean value for the exponent k was only 0.974 with a standard deviation of the single value of 0.0028.

Exemplary Embodiment 2

The entire surface of the cigarette paper of Comparative Example 2 was coated with a film-forming composition, specifically with an aqueous colloidal solution of 1.0% by weight of a cationic starch, Cationamyl®, using the laboratory printer. The paper was dried after coating and the applied amount was determined to be 1.57 g/m$^2$ by measurement of the basis weight in accordance with ISO 536 before and after coating. The air permeability and the exponent k were measured 10 times in accordance with ISO 2965:2009 with a Borgwaldt A10 instrument and a measuring head with a rectangular opening of 2 mm by 15 mm and the mean value was calculated. The mean value for the air permeability was 53.7 CU, the mean value for the exponent k was only 0.972 with a standard deviation of the single value of 0.0026.

Exemplary Embodiment 3

The entire surface of the cigarette paper of Comparative Example 2 was coated with a film-forming composition, specifically with an aqueous solution of 0.5% by weight of a carboxy methyl cellulose, Blanose® CMC 7MCF and adding 5.0% by weight of chalk, using the laboratory printer. The paper was dried after coating and the applied amount was determined to be 1.60 g/m$^2$ by measurement of the basis weight in accordance with ISO 536 before and after coating. The air permeability and the exponent k were measured 10 times in accordance with ISO 2965:2009 with a Borgwaldt A10 instrument and a measuring head with a rectangular opening of 2 mm by 15 mm and the mean value was calculated. The mean value for the air permeability was 46.8 CU, the mean value for the exponent was only 0.937 with a standard deviation of the single value of 0.0036.

Exemplary Embodiment 4

The entire surface of the cigarette paper of Comparative Example 2 was coated with a film-forming composition, specifically with an aqueous solution of 0.5% by weight of a carboxy methyl cellulose, Blanose® CMC 7MCF and an addition of 5.0% by weight chalk, using the laboratory printer. The paper was dried after coating and the applied amount was determined to be 1.46 g/m$^2$ by measurement of the basis weight in accordance with ISO 536 before and after coating. The air permeability and the exponent k were measured 10 times in accordance with ISO 2965:2009 with a Borgwaldt A10 instrument and a measuring head with a rectangular opening of 2 mm by 15 mm and the mean value was calculated. The mean value for the air permeability was 48.7 CU, the mean value for the exponent k was only 0.898 with a standard deviation of the single value of 0.0052.

Exemplary Embodiment 5

The cigarette paper of Comparative Example 1 was treated according to the method of exemplary embodiment 2. The applied amount was determined to be 1.20 g/m$^2$ by measurement of the basis weight in accordance with ISO 536 before and after coating. The air permeability and the exponent k were measured 10 times in accordance with ISO 2965:2009 with a Borgwaldt A10 instrument and a measuring head with a rectangular opening of 2 mm by 15 mm and the mean value was calculated. The mean value for the air permeability was 82.5 CU, the mean value for the exponent was only 0.961 with a standard deviation of the single value of 0.0043.

Exemplary Embodiment 6

The cigarette paper of Comparative Example 1 was treated according to the method of exemplary embodiment 4. The applied amount was determined to 1.56 g/m$^2$ by measurement of the basis weight in accordance with ISO 536 before and after coating. The air permeability and the exponent k were measured 10 times in accordance with ISO 2965:2009 with a Borgwaldt A10 instrument and a measuring head with a rectangular opening of 2 mm by 15 mm and the mean value was calculated. The mean value for the air permeability was 82.5 CU, the mean value for the exponent k was only 0.826 with a standard deviation of the single value of 0.0064.

The above exemplary embodiments show that the exponent k can be decreased in the manner described to values far below 0.98 without dramatically reducing the air permeability in accordance with ISO 2965. The observed reduction in air permeability in accordance with ISO 2965 can be compensated for by an increased initial air permeability of the base paper, for example, by reduced refining. The film-forming compositions used do not lead to noticeable adverse effects on the taste of the smoke compared with the base paper and do not result in a significant chemical change of the smoke; instead—at pressure differences below 1.0 kPa, which usually occur during normal smoking—solely in an advantageous dilution compared with a conventional cigarette paper with the same air permeability in accordance with ISO 2965 and an exponent k close to 1.

The invention claimed is:

1. A cigarette paper having a surface, at least a part of the surface having the following properties:

no artificial perforation an air permeability of at least 15 CU, and for an exponent k measured with a measuring head with a rectangular opening of 2 mm by 15 mm in accordance with ISO 2965:2009, which is defined as:

$$k = \frac{\log \frac{Q_1}{Q_2}}{\log \frac{p_1}{p_2}}$$

where:

$Q_1$ represents air-flow through the paper at a pressure difference $p_1$=1.00 kPa, $Q_2$ represents air-flow through the paper at a pressure difference $p_2$=0.25 kPa, and wherein $k \leq 0.98$ and $k \geq 0.8$, wherein the exponent k in said part of the surface varies over a length of the surface.

2. The cigarette paper according to claim 1, wherein said part of the surface has a first part and a second part, wherein the exponent k is less in the first part than in the second part.

3. The cigarette paper according to claim 1, wherein registration marks are provided which are in register with said part of the surface.

* * * * *